US005678897A

United States Patent [19]

Prestia

[11] Patent Number: 5,678,897

[45] Date of Patent: Oct. 21, 1997

[54] READY-TO-ASSEMBLE UPHOLSTERED FURNITURE

[75] Inventor: Joseph C. Prestia, Fountain Valley, Calif.

[73] Assignee: Ira S. Meyers, Highland Park, Ill.

[21] Appl. No.: 506,106

[22] Filed: Jul. 24, 1995

[51] Int. Cl.[6] ..... A47C 7/00

[52] U.S. Cl. ..... 297/440.15; 297/440.23; 297/452.18

[58] Field of Search ..... 297/440.1, 440.15, 297/440.23, 452.18, 452.52, 218.3, 218.5

[56] References Cited

U.S. PATENT DOCUMENTS

| | | | |
|---|---|---|---|
| 1,303,535 | 5/1919 | Bonel . | |
| 2,642,928 | 6/1953 | Bateman et al. | 155/179 |
| 2,732,889 | 1/1956 | Healey | 155/196 |
| 3,030,146 | 4/1962 | Faxon | 297/422 |
| 3,170,729 | 2/1965 | Grant | 297/440 |
| 3,608,959 | 9/1971 | Sarvas | 297/218 |
| 3,674,311 | 7/1972 | Miller | 297/440 |
| 4,077,517 | 3/1978 | Hilemn | 206/577 |
| 4,165,902 | 8/1979 | Ehrlich | 297/440 |
| 5,263,764 | 11/1993 | Laughlin et al. | 297/440.23 |

OTHER PUBLICATIONS

The First Years (flyer© 1994).
Kids II (flyer©1994).
Safety 1st (flyer© 1994).
one (1) copy of an advertisement depicting an RTA Sofa manufactured by Blackwelder Industries.
one (1) copy of four (4) photographs of an RTA Sofa manufactured by Ameriwood Industries (2 pp.).

*Primary Examiner*—Milton Nelson, Jr.
*Attorney, Agent, or Firm*—Olson & Hierl, Ltd.

[57] ABSTRACT

A ready-to-assemble (RTA) article of furniture is provided which includes a frame structure comprising a plurality of separate couplable and securable component members including a back member with opposite side posts which each include a notch, two arm members, and a seat member including opposite sides which each include a rear end which is received in each of the notches in the back member respectively during assembly to support and position the seat member about the back member and the two arm members. A wing-nut bolt assembly is provided for compressing the upholstery between the arm members and back member during assembly. A fastening screw and insert combination is provided for securing the arm members to the back member and then the seat member to the arm members.

18 Claims, 5 Drawing Sheets

READY-TO-ASSEMBLE UPHOLSTERED FURNITURE

TECHNICAL FIELD OF THE INVENTION

This invention relates to furniture and, more particularly, to upholstered ready-to-assemble (RTA) furniture such as chairs, love seats, couches and sofas which can easily be assembled or disassembled by a consumer-purchaser.

BACKGROUND OF THE INVENTION

Ready-to-assemble (RTA) upholstered furniture comprises upholstered furniture such as chairs, love seats, couches and sofas which are purchased by consumers as a kit including separate component members which are assembled and secured together by the consumer. Such RTA furniture, whose components may be packaged in separate cartons small enough to fit in an automobile or the like, has afforded the furniture retailer such advantages as more space in their warehouses, reduced freight and delivery charges, and the ability to easily and efficiently replace defective component members. RTA furniture has afforded the consumer such advantages as the ability to take furniture home immediately after purchase instead of waiting for delivery by the retailer, ease of transportability in automobiles and through restrictive passageways and doorways, and ease of assembly and disassembly.

Notwithstanding the above advantages, RTA furniture has suffered the disadvantage of being less sturdy and durable than its factory assembled counterpart because of the RTA's furniture component member structure as opposed to the unitary construction of the factory assembled furniture. Further, RTA furniture has used member fasteners which do not always adequately secure the component members together and have a tendency to loosen over time. Moreover, some of the component members have been constructed such that, during assembly, the members cannot easily be oriented with respect to each other for coupling and positioning purposes.

Thus, there remains a need for RTA furniture of improved sturdiness and durability. There also remains a need for RTA furniture including component members which can be easily oriented with respect to each other and efficiently and quickly coupled and connected together during assembly.

SUMMARY OF THE INVENTION

The present invention fills the need for sturdy and durable ready-to-assemble (RTA) upholstered furniture which can easily be assembled and disassembled by ordinary consumers.

The present invention is an article of furniture including a frame structure comprising a back member including opposite side posts and a notch in each of the side posts. First and second arm members are secured to the back member. A seat member has opposite sides which each include an opposite rear end that is seatable in a different one of the notches so that the seat member is positioned and rearwardly supported by the side posts. The seat member is secured to the first and second arm members, and the back member, arm members, and seat member mutually support one another.

According to the invention, each of the side posts of the back member includes opposed side faces and a front face therebetween and the notch extends into the front face.

The seat member includes spaced-apart front and back rails connected by spaced-apart side rails. Each of the side rails includes the rear end which is seatable in the notch in each of the side posts of the back member respectively.

In one embodiment, each of the side posts includes a leg having a front face and the notch extends into the front face of the leg.

According to the invention, compression means comprising a wing nut and bolt assembly extend between and through each of the side posts of the back member and the first and second arm members respectively for compressing the upholstery on the back member and arm members during assembly of the arm members to the side posts of the back member.

First fastening means comprising a fastening screw and insert combination extend between and through openings in the side posts of the back member and the first and second arm members respectively for securing the first and second arm members to the back member after the upholstery on the back member and arm members has been compressed during assembly.

Second fastening means also comprising a fastening screw and insert combination extend between and through openings in the side rails of the seat member and the first and second arm members respectively for securing the seat member to the first and second arm members during assembly.

The notches in the side posts of the back member advantageously allow for the quick and efficient supporting, positioning and orienting of the seat member about the back member during assembly.

The notch further allows the advantage of allowing the automatic alignment of the openings in the seat member and the arm members during assembly so that such members can be quickly secured together.

The wing nut and bolt assembly advantageously provides for the compression of the upholstery on the furniture to allow the easy securement of the arm members to the back member with the fastening screw and insert combination.

The fastening screw and insert combination advantageously provides for the tight securement of the members together to provide an article of RTA furniture of durable and sturdy construction.

Numerous other advantages and features of the present invention will become readily apparent from the following detailed description of the invention and the embodiments thereof, form the claims and from the accompanying drawings in which details of the invention are fully and completely disclosed as part of this specification.

BRIEF DESCRIPTION OF THE DRAWIN

In the drawings;

FIG. 1 a perspective view of a sofa embodying the feature of the present invention;

DESCRIPTION OF THE PREFERRED EMBODIMENT

Figure 1:
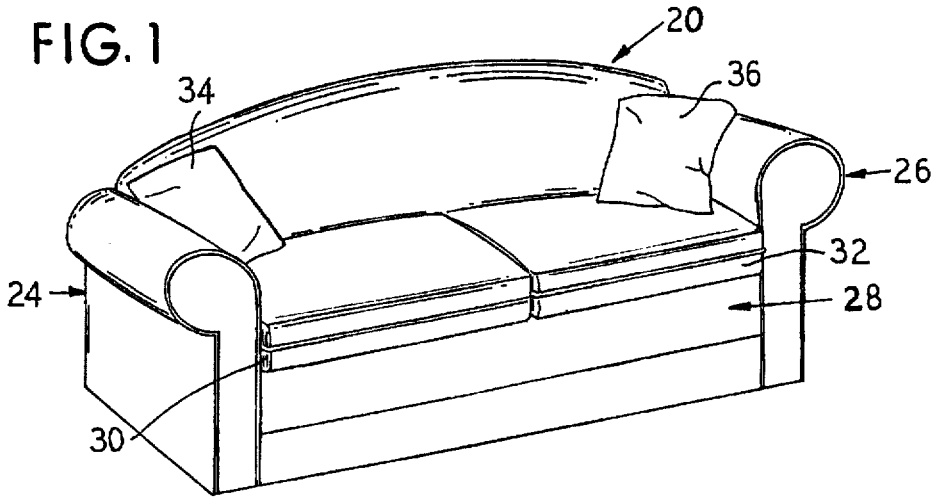

The disclosed invention is, of course, susceptible of embodiment in many different forms. Shown in the drawings and described below in detail is a preferred embodiment of the invention as a upholstered ready-to-assemble (RTA) sofa. It is to be understood, however, that the present disclosure is an exemplification of the principles of the invention which are likewise applicable to other types of upholstered RTA furniture such as, but not limited to, upholstered RTA chairs, loveseats and couches.

For ease of description, the ready-to-assemble (RTA) furniture embodying the present invention is described below in its usual assembled position as shown in the accompanying drawings and terms such as upper, lower, side, front, back, etc., will be used with reference to this usual position. The terms vertical and horizontal refer to the directions substantially perpendicular and parallel respectively to the horizontal surface on which the furniture is placed.

Some of the figures illustrating the RTA furniture of the invention show structural details and mechanical elements that will be recognized by one skilled in the art. However, the detailed descriptions of such elements are not necessary to an understanding of the invention, and accordingly, are not presented.

Referring now to FIG. 1, there is depicted an upholstered ready-to-assemble (RTA) sofa 20 embodying the features of the present invention which can be shipped and subsequently purchased in the disassembled or knockdown form of FIG. 2.

Figure 2:
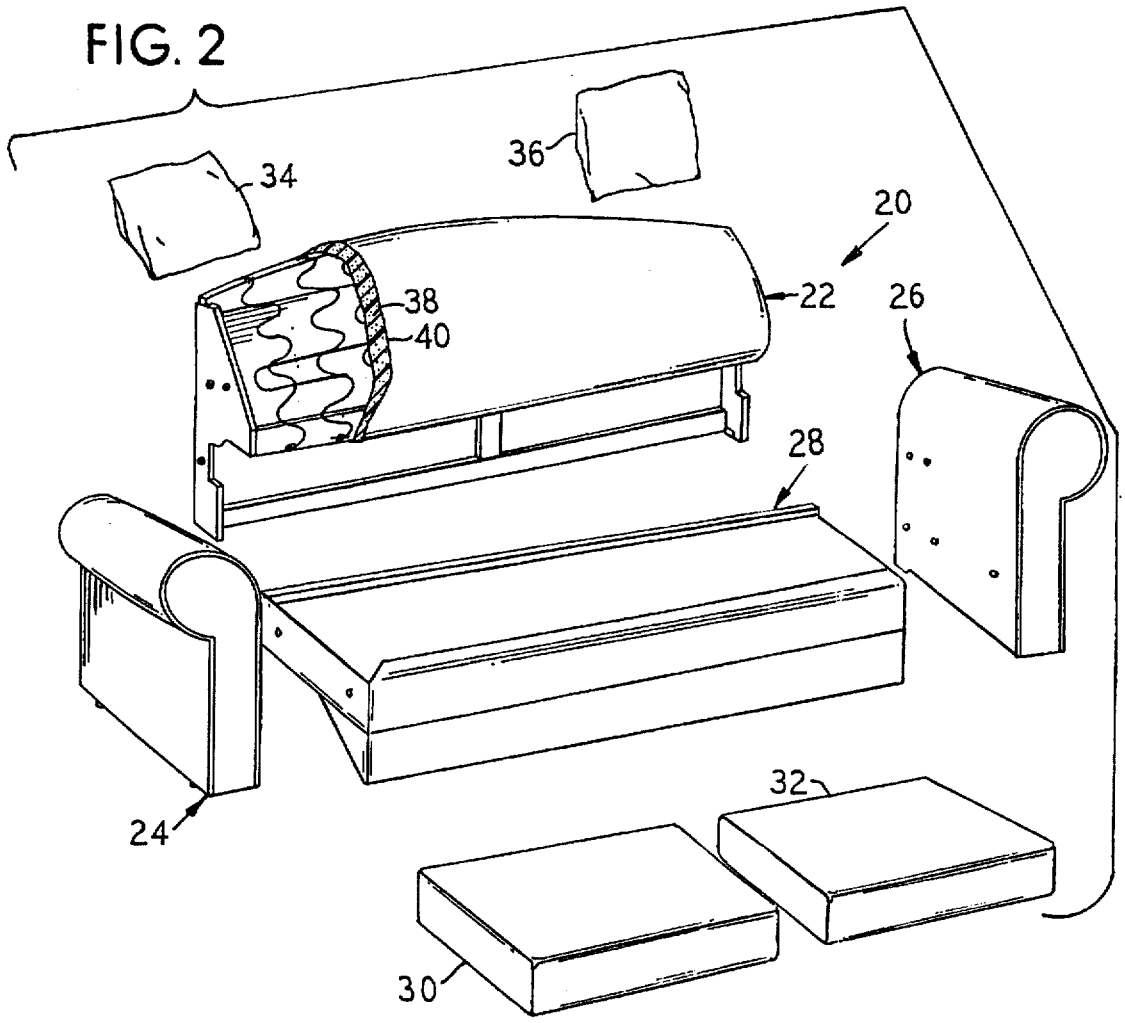
FIG. 2 is an exploded perspective, partially broken, view of the sofa of FIG. 1 depicting the component members thereof.

As shown in FIG. 2, the sofa 20 comprises a vertical back member 22, right-hand and left-hand vertical arm members 24 and 26 respectively and a horizontal seat member 28. The sofa 20 also includes two seat cushions 30 and 32 which are seated on the seat member 28 and two loose decorative pillows 34 and 36. The seat cushions 30 and 32 may, of course, be replaced with a single seat cushion or a plurality of seat cushions depending upon the style of the sofa. In a like manner, the pillows 34 and 36 may be replaced with large back cushions similar in size to the seat cushions 30 and 32 depending again upon the style of the sofa. Each of the sofa members 22, 24, 26 and 28 is upholstered, covered and completed at the furniture factory as individual separate shippable units.

To facilitate and simplify the description of the sofa 20 and, more particularly, the component members 22, 24, 26 and 28 thereof, the sofa 20 and its component members are depicted in FIGS. 3–11 in their nonupholstered frame form. It is understood, of course, that the sofa 20 and its component members are purchased in the fully upholstered form depicted in FIG. 2 with the foam material or padding 38 and the fabric cover 40 thereon. The frame structure of each of the sofa component members may be made of any suitable material such as, but not limited to, wood, fiberboard, metal, plastic or a combination of these materials. The frames may be integrally cast or molded or, as shown in the drawings, fabricated of structural elements that are stapled or otherwise secured together, the intent being to provide frames that are light and strong for their intended purposes.

Figure 3:
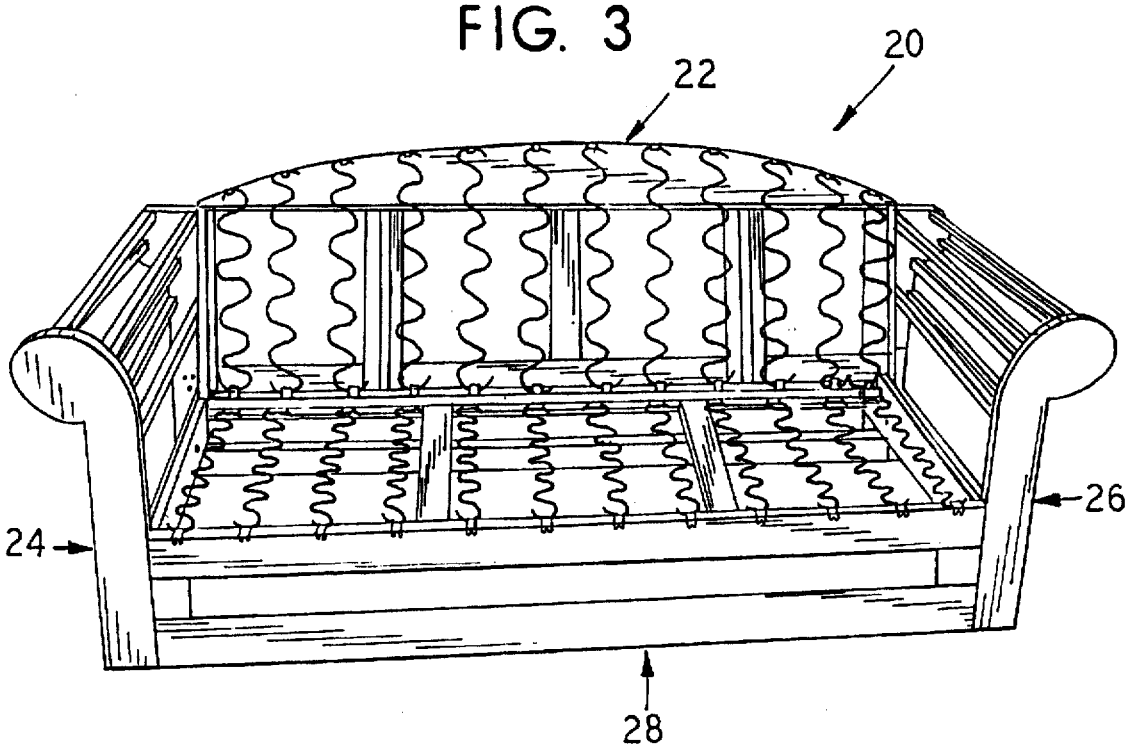
FIG. 3 is a perspective view of the frame of the sofa of FIG. 1.
Figure 4:
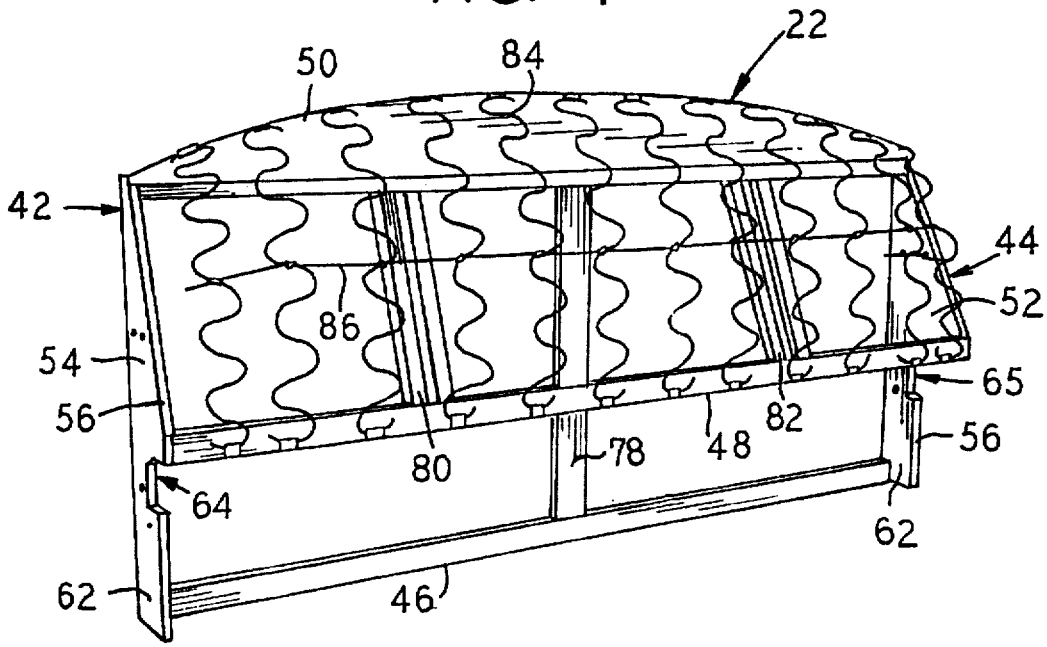
FIG. 4 is a perspective view of the frame of the back member of sofa depicted in FIG. 3.
Figure 5:
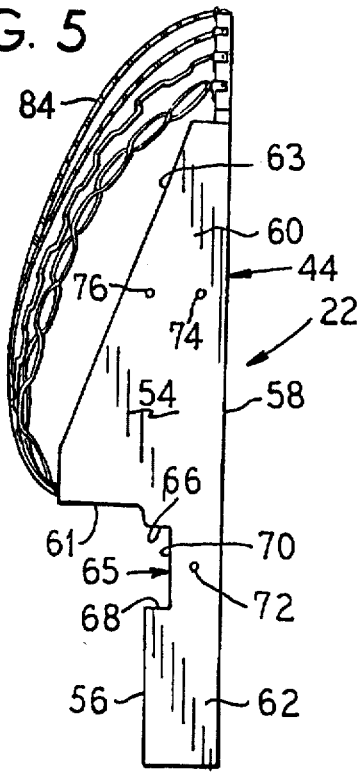
FIG. 5 is a side elevational view of the sofa back member depicted FIG. 4.

Referring to FIGS. 3–5, the vertical back member 22 includes opposite, elongate, spaced-apart vertical right-hand side and left-hand side posts 42 and 44 respectively and horizontal elongate cross-rails 46, 48, and 50 extending transversely between and connecting the side posts 42 and 44. Each of the side posts 42 and 44 includes opposed vertical inner and outer side surfaces or faces 52 and 54 respectively and front and back vertical surfaces or faces 56 and 58 respectively therebetween. Each of the side posts 42 and 44, when viewed from the side as shown in FIG. 5, is generally in the shape of the numeral four and includes an upper or top portion 60 generally in the shape of a right triangle and a lower generally rectangularly shaped leg portion 62 unitary with the triangular portion 60. The leg portion 62 extends vertically downwardly from the triangular portion 60 to the surface upon which the back member 22 rests vertically.

Referring to FIG. 5, the triangular portion 60 on each of the side posts 42 and 44 includes a base side 61 extending generally perpendicularly outwardly from the leg portion 62 and a hypotenuse side 63 extending angularly upwardly from the end of the base side 61 towards the top of the posts 42 and 44 respectively.

The side posts 42 and 44 further include notches 64 and 65 respectively which are cut out of and extend inwardly into the front face 56 thereof. More particularly, notches 64 and 65 are cut out of the leg portion 62 of the side posts 42 and 44 respectively in the region of the leg portion 62 immediately below the base side 61 of the triangular top portion 60, i.e., in the region where the leg portion 62 unitarily joins the upper triangular portion 60. Each of the notches 64 and 65 is defined by spaced-apart, parallel top and bottom horizontal inner surfaces or faces 66 and 68 respectively and an inner vertical surface or face 70 therebetween (FIG. 5).

Each of the side posts 42 and 44 is also provided with screw or bolt openings 72, 74 and 76 which extend between the inner and outer side faces 52 and 54 thereof. Opening 72 is located in the leg portion 62 adjacent to and generally behind each of the notches 64 and 65 respectively while openings 74 and 76 are located in the top triangular portion 60 and positioned therein in spaced, side-by-side relationship.

Horizontal rail 46 is positioned at the bottom of the back member 22 generally adjacent the surface upon which the sofa 20 is seated and is coupled to and extends between the inner vertical faces 52 of the leg portion 62 of posts 42 and 44 respectively. Horizontal rail 48 is an intermediately positioned rail which is coupled to and extends between the inner vertical faces 52 of the posts 42 and 44 respectively in the region of the triangular portion 60 thereof where the hypotenuse side 63 extends away from the base side 61. Horizontal rail 50, which is generally curved, is positioned at the top of the back member 22 and is coupled to and extends between the inner vertical faces 52 at the top of the triangular portion 60 of the posts 42 and 44 respectively.

An elongate support bracket 78 is coupled to the cross rails 46, 48 and 50. Bracket 78 is positioned generally centrally on the back member 22 parallel to the posts 42 and 44 and transversely to the cross rails 46, 48 and 50. Two smaller angled support brackets 80 and 82, positioned on opposite sides of bracket 78, are coupled to and extend transversely between the cross rails 48 and 50.

A plurality of sinuous support springs 84 are spaced along the length of the back member 22 between the posts 42 and 44. Springs 84 are positioned generally parallel to the side posts 42 and 44 and are coupled to and extend perpendicularly between the cross-rails 48 and 50. A string 86 is coupled to and extends transversely between the springs 84 for keeping the springs 84 in their spaced, parallel relationship.

Figure 6:
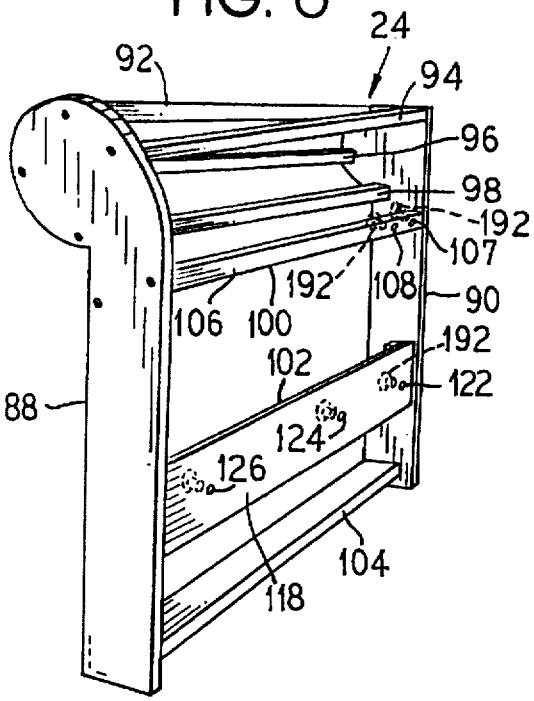
FIG. 6 is a perspective view of the frame of the right-hand arm member of the sofa depicted in FIG. 3.
Figure 7:
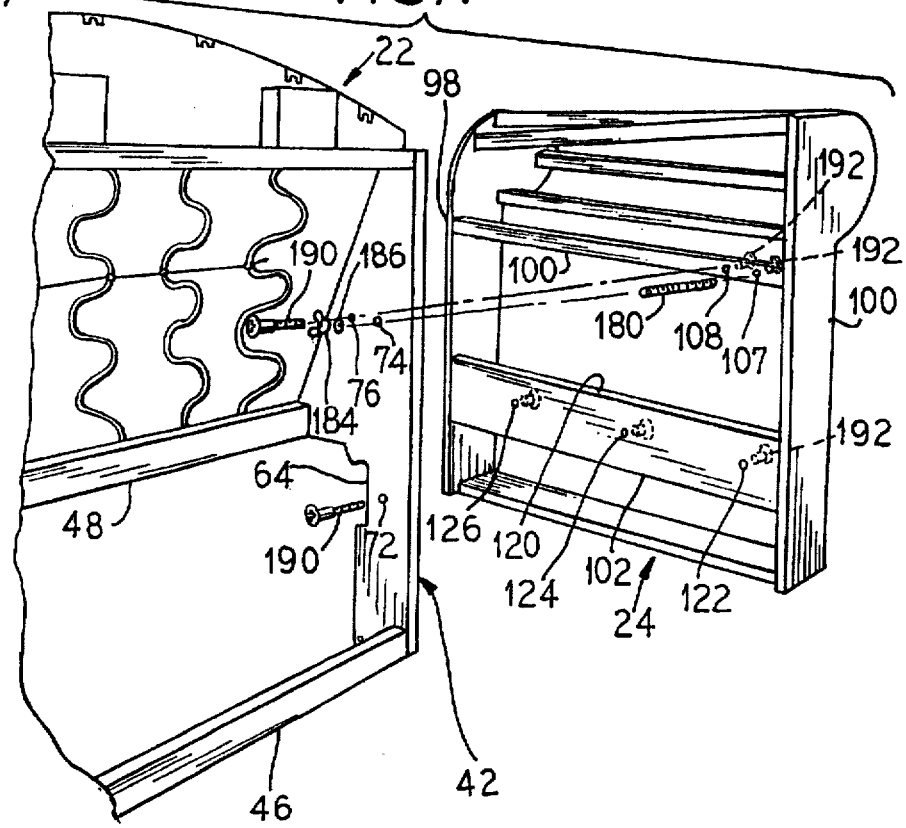
FIG. 7 is a partially broken perspective view depicting the connection of the right-hand arm member to the back member.

Referring to FIGS. 6 and 7, right-hand arm member 24 includes spaced apart parallel front and back elongate vertical posts 88 and 90 respectively and a plurality of cross horizontal rails 92, 94, 96, 98, 100, 102 and 104 extending generally transversely between and coupled to the front and back posts 88 and 90 to form the arm member 24. Cross horizontal rail 100 includes an inner surface 106 with an opening 107, located adjacent the distal end of rail 100, within which a screw insert 192 of a fastening bolt 180 (FIG. 11) is threadingly secured during manufacture of the arm member 24. An opening 108, within which a screw insert 192 of a fastening screw 190 is threadingly secured during manufacture of the arm member 24, is located in the rail 100 adjacent to and in alignment with the opening 170 therein. Cross rail 100 is positioned on the arm member 24 such that the openings 107 and 108 therein are aligned with the openings 74 and 76 respectively in the side post 42 of back member 22 when the arm member 24 is coupled and secured to the back member 22 during assembly as described below.

Cross horizontal rail 102, which is positioned below the cross rail 100 and includes vertical inner and outer surfaces 118 and 120 respectively, includes three spaced apart co-linear openings 122, 124 and 126 within which three fastening screw inserts 192 (FIG. 11) are respectively threadingly secured during manufacture of the arm member 24. Openings 122 and 126 are positioned generally adjacent the proximal and distal ends of the cross-rail 102 respectively while opening 124 is positioned generally centrally on the rail 102 between the openings 122 and 126. Cross-rail 102 is positioned on the arm member 24 such that the opening 122 therein aligns with the opening 72 in side post 42 of back member 22 when arm member 24 is coupled and secured to the back member 22 during assembly as described below.

Although not shown or described, it is understood that the left-hand arm member 26 is a mirror image of arm member 24. Thus, it is understood that, when the sofa 20 is assembled, openings 107 and 108 in cross-rail 100 of arm member 26 align with the openings 74 and 76 respectively in side post 44 of back member 22 and that the opening 122 in cross-rail 102 of arm member 26 aligns with the opening 72 in side post 44.

Figure 8:
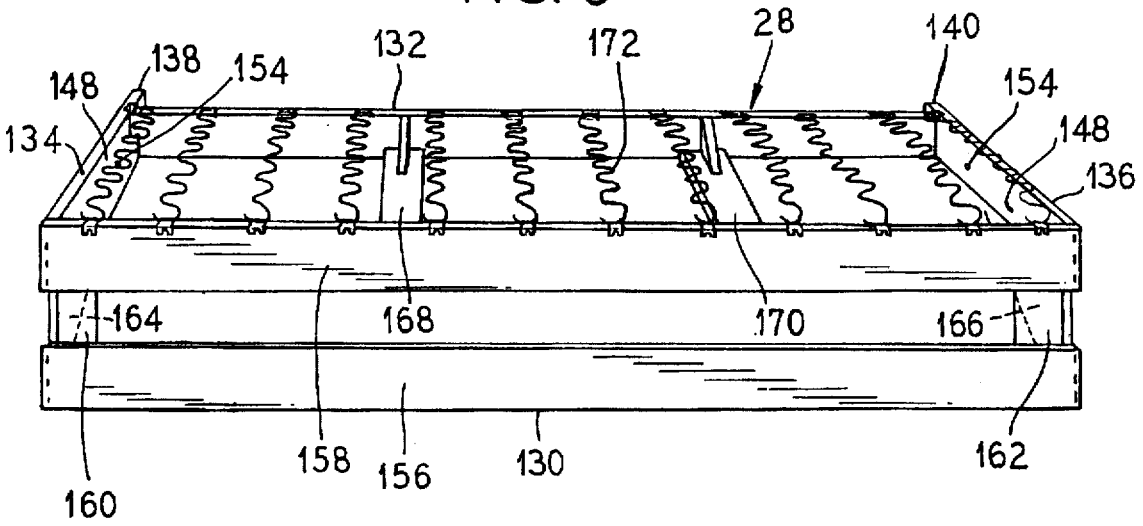
FIG. 8 is a perspective view of the frame of the seat member of the sofa depicted in FIG. 3.
Figure 9:
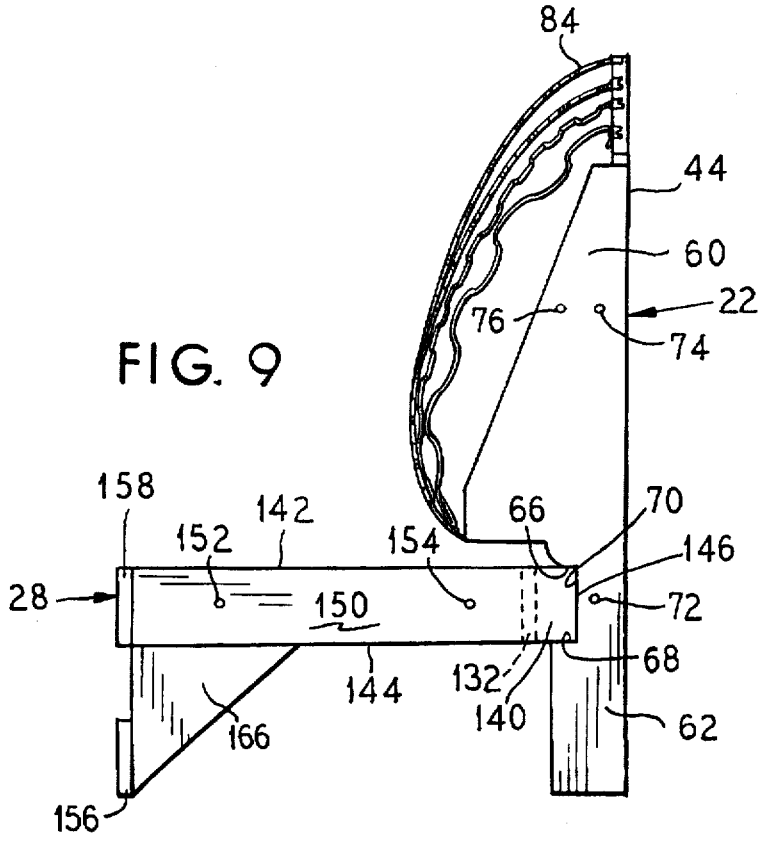
FIG. 9 is a side elevational view depicting the coupling of the seat member to the back member.

Referring to FIGS. 8 and 9, seat member 28 is comprised of a longitudinally extending horizontal front rail 130, a longitudinally extending horizontal back rail 132 which is spaced from the front rail 130, and a pair of spaced horizontal side rails 134 and 136 extending transversely to and coupled to the ends of the front and back rails 130 and 132 respectively to form a generally rectangularly or box shaped seat member 28.

The side rails 134 and 136 include free distal or rear ends 138 and 140 respectively which extend rearwardly beyond the outer face of back rail 132. Each of the side rails 134 and 136 and, more particularly, each end 138 and 140 thereof respectively, includes top and bottom horizontal surfaces or faces 142 and 144 respectively, a vertical end surface or face 146 and inner and outer vertical surfaces or faces 148 and 150, respectively.

Each of the side rails 134 and 136 further includes two spaced apart, co-linear fastening bolt or screw openings 152 and 154. Opening 152 is positioned centrally adjacent the proximal end of side rail 136 while opening 154 is positioned centrally in the side rail 136 adjacent the distal end 140 thereof. Although not shown, it is understood that openings 152 and 154 in side rail 134 are similarly positioned.

Front rail 130 includes two spaced apart longitudinally extending parallel members 156 and 158 which are separated by spacer blocks 160 and 162 positioned at opposite ends of the front rail 130. Member 156 is positioned adjacent the surface upon which sofa 20 is seated. Back rail 132 is a longitudinally extending horizontal member having a width generally equal to the width of one of the members 156 and 158 of the front rail 130.

Seat member 28 further includes two triangularly shaped support brackets 164 and 166 mounted at opposite ends of the seat member 28 beneath the side rails 134 and 136 respectively. The brackets 164 and 166 are coupled to and extend rearwardly from the inner surface of front rail member 156 and then upwardly into the bottom surfaces 144 of side rails 134 and 136 respectively. Elongate support brackets 168 and 170 are coupled to and extend transversely between the inner faces of the front rail member 158 and the back rail 132. A plurality of elongate sinuous springs 172 extend in spaced and parallel relationship along the length and top of the seat member 28. The ends of the springs 172 are coupled to the top of the front and back rails 130 and 132 respectively.

The openings 152 and 154 are positioned in each of the side rails 134 and 136 of seat member 28 so as to be in alignment with the openings 126 and 124 respectively in each of the arm members 24 and 26 when the seat member 28 is coupled and secured to the arm members 24 and 26 during assembly as described below.

As previously stated, each of the framed components of the sofa 20, i.e., the back member 22, the seat member 28 and the arm members 24 and 26, are manufactured and completely assembled, padded and upholstered at the factory, whereupon the separate units may be stacked and shipped to the furniture retailer in much smaller cartons than is ordinarily used in the shipping of furniture thus affording the furniture retailer a great saving in freight and delivery rates, shipping space, and warehouse space.

The purchaser, on the other hand, is afforded the advantage of easy transportability in an automobile or the like from the point of purchase to the point of assembly. Moreover, the purchaser is afforded the benefit of quick and easy assembly as described below.

Once a purchaser unpacks the component members from its cartons, the back member 22 is layed flat on its side posts 42 and 44. Arm members 24 and 26 are then coupled to and secured to the back member 22. More particularly, and referring to FIG. 7, bolt 180 is initially inserted into opening 107 in cross-rail 100 of arm 24 and threadingly secured into the insert 192 therein. Then, arm 24 is moved laterally towards the side post 42 of back member 22 and bolt 180 therein is inserted through the opening 74 in side post 42. Arm member 24 is then moved further laterally into contact with the sidepost 42 and opening 108 in cross rail 100 of arm member 24 is aligned co-linearly with opening 76 in side post 42 and opening 122 in cross rail 102 of arm member 24 is aligned with the opening 72 in side post 42. Then, a wing nut 184 with a washer 186 (FIG. 11) is threadingly secured to the bolt 180 to compress the foam material 40 (not shown) on the members 22 and 24. After the foam 40 has been adequately compressed, two fastening screws 190 (FIG. 11) are inserted through the aligned openings 76 and 108 in side post 42 and cross rail 102 respectively and openings 72 and 122 in side post 42 and cross rail 100 respectively. The screws 190 are subsequently threadingly secured within the inserts 192 in openings 108 and 122 respectively.

Although not described, it is understood that the left-hand arm member 26 is secured to the back member 22 and, more particularly, to the left side post 44 thereof, in a manner identical to that described above with respect to arm member 24.

Figure 10:
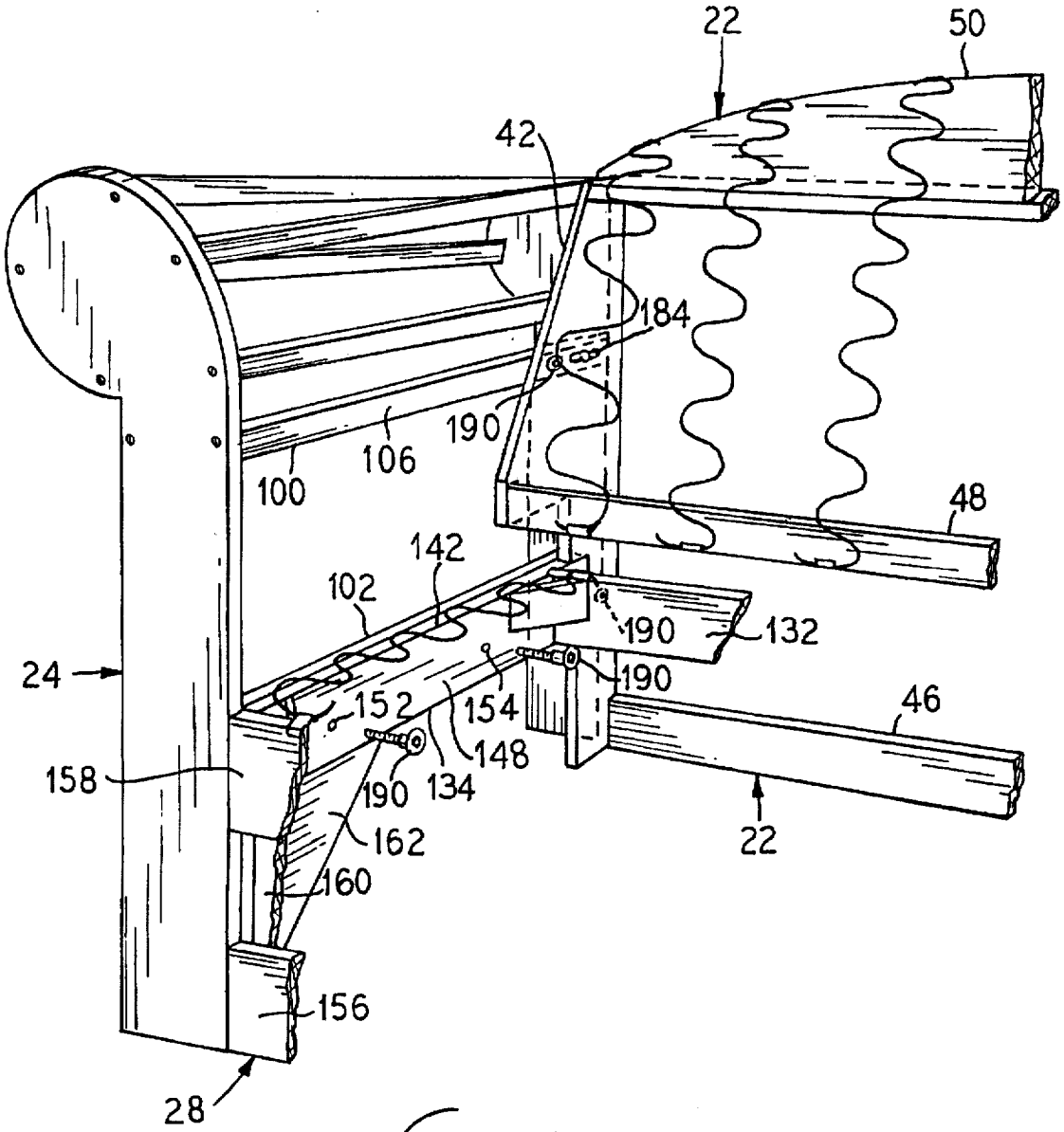
FIG. 10 is a partially broken perspective view of the back member, the seat member and the right-hand arm member in coupled relationship.
Figure 11:
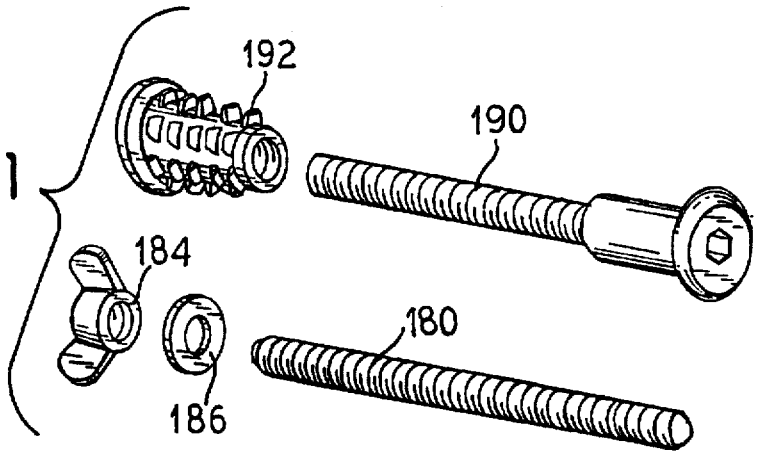
FIG. 11 is an enlarged perspective view of the fastening means used to secure the sofa component members together.

Referring to FIGS. 9 and 10, once both the arm members 24 and 26 have been secured to the back member 22, the seat member 28 is positioned between the arm members 24 and 26 and dropped into the notches 64 and 65 in back member 22. More particularly, the free ends 138 and 140 of side rails 134 and 136 respectively of seat member 28 are inserted and seated in the notches 64 and 65 respectively in the side posts 42 and 44 of back member 22 so that the seat member 28 is positioned and oriented about the back member 22 and rearwardly supported by the side posts 42 and 44 respectively of the back member 22.

In this seating arrangement, the surfaces 142, 144 and 146 of the free ends 138 and 140 abut the surfaces 66, 68 and 70 respectively of notches 64 and 65 respectively and the seat member 28 is thus firmly and securely supported by the side posts 42 and 44 of back member 22. The positioning of the ends 138 and 140 of the seat member 28 within the notches 64 and 65 respectively also provides for the automatic alignment and positioning of the side rails 134 and 136 of seat member 28 with the cross rail 102 of arm members 24 and 26 respectively and thus the alignment and positioning of the openings 152 and 154 in side rails 134 and 136 with the openings 126 and 124 respectively in each of the arm members 24 and 26 so that fastening screws 190 may easily and quickly be inserted therethrough from the inner surface of rails 134 and 136 into threading engagement with the inserts 192 in openings 124 and 126 to complete the assembly of sofa 20. The sofa 20 may be disassembled in a like manner as quickly 10 assembly as it is assembled.

What has thus been described is an RTA sofa 20 comprising a plurality of mutually supportable component members which can easily and quickly be oriented with respect to each other during assembly and subsequently coupled and secured together to create and provide a sofa of durable construction.

Finally, it is understood that numerous variations and modifications of the embodiment described above may be effected without departing from the spirit and scope of the novel features of the invention. It is to be understood that no limitations with respect to the specific device illustrated herein are intended or should be inferred. It is, of course, intended to cover by the appended claims all such modifications as fall within the scope of the claims.

I claim:

1. An article of furniture including a frame structure comprising:

a back member including opposite side posts connected by intermediate rails, each of said side posts having a notch;

first and second arm members secured to said back member; and a seat member including spaced front and back rails and opposite side rails, each of said side rails including a rear end extending beyond said back rail that is seatable within a different one of said notches in said back member so that said seat member is positioned and rearwardly supported by said side posts, said seat member additionally being secured along each one of said opposite side rails to a different one of said first and second arm members;

whereby said back member, said arm members and said seat member mutually support one another.

2. The article of furniture of claim 1 wherein each of said side posts includes a front face, said notch extending into said front face of each of said side posts.

3. The article of furniture of claim 1 wherein each of said side posts includes opposed side faces and a front face therebetween, said notch extending into said front face of each of said side posts.

4. The article of furniture of claim 1 wherein each of said side posts is positioned substantially vertically and includes a leg with a front face, said notch extending into said front face of said leg of each of said side posts.

5. The article of furniture of claim 1 wherein each of said side posts is positioned substantially vertically and includes opposed side faces and a front face therebetween, each of said side posts including an upper triangularly shaped side face portion and a lower leg unitary therewith which extends substantially vertically downwardly therefrom, said notch extending into said front face of said leg of each of said side posts.

6. The article of furniture of claim 1 wherein said front and back rails are connected to said side rails.

7. An article of furniture including a frame structure comprising:

a back member including opposite side posts connected by intermediate rails, each of said side posts having a notch;

first and second arm members secured to said back member; and a seat member having opposite side rails, each of said side rails including a rear end that is seatable in a different one of said notches so that said seat member is positioned and rearwardly supported by said side posts of said seat member, each of said side rails of said seat member including top and bottom horizontal faces and a front vertical face therebetween, said notch in each of said side posts of said back member including top and bottom inner horizontal faces and a front inner vertical face therebetween, said top, bottom and front inner faces of said notch abutting said top, bottom and front faces of said side rails respectively when said ends of said side rails are seated in said notch in each of said side posts of said back member respectively, said seat member additionally being secured along each one of said opposite sides to a different one of said first and second arm members;

whereby said back member, said arm members and said seat member mutually support one another.

8. An article of furniture including a frame structure comprising:

a back member including opposite spaced side posts connected by intermediate transverse cross-rails therebetween, each of said side posts having opposed inner and outer side faces and a front face therebetween, said intermediate cross-rails being coupled to and extending transversely between said inner side faces of said opposed side posts, each of said side posts including a leg with a notch extending into said front face thereof;

first and second arm members secured to said side posts of said back member; and a seat member including spaced front and back rails connected by opposed transverse side rails, each of said side rails including a rear free end extending beyond said back rail, said free end of one of said side rails being seatable in said notch in one of said side posts of said back member and said free end of the other of said side rails of said seat member being seatable in said notch in the other of said side posts of said back member for rearwardly supporting said seat member about said back member and positioning said seat member about said first and second arm members, said side rails of said seat member additionally being secured to said first and second arm members, respectively.

9. An article of furniture including a frame structure comprising:

a back member including opposite spaced side posts connected by intermediate transverse cross-rails therebetween each of said side posts having opposed inner and outer side faces and a front face therebetween said intermediate cross-rails being coupled to and extending transversely between said inner side faces of said opposed side posts, each of said side post of including a leg with a leg with a notch extending into said front face thereof, each of said side posts of said back member further including an upper triangularly shaped side face portion, said leg being unitary therewith and extending substantially vertically downwardly therefrom;

first and second arm members secured to said side posts of said back member; and a seat member including spaced front and back rails connected by opposed transverse side rails, each of said side rails including a rear free end extending beyond said back rail, said free end of one of said side rails being seatable in said notch in one of said side posts of said back member and said free end of the other of said side rails of said seat member being sealable in said notch in the other of said side posts of said back member for rearwardly supporting said seat member about said back member and positioning said seat member about said first and second arm members, said side rails of said seat member additionally being secured to said first and second arm members, respectively.

10. An article of furniture including a frame structure comprising:

a back member including opposite spaced side posts connected by intermediate transverse cross-rails therebetween, each of said side posts having opposed inner and outer side faces and a front face therebetween, said intermediate cross-rails being coupled to and extending transversely between said inner side faces of said opposed side posts, each of said side posts including a leg with a notch extending into said front face thereof;

first and second arm members secured to said side posts of said back member; and a seat member including spaced front and back rails connected by opposed transverse side rails, each of said side rails including a rear free end extending beyond said back rail, said free end of one of said side rails being seatable in said notch in one of said side posts of said back member and said free end of the other of said side rails of said seat member being seatable in the other of said side posts of said back member, each of said side rails of said seat member including top and bottom horizontal faces and a front vertical face therebetween, said notch in each of said side posts of said back member including top and bottom inner horizontal faces and a front inner vertical face therebetween, said top, bottom and front inner faces of said notch abutting said top, bottom and front faces of said side rails respectively when said ends of said side rails are seated in said notch in each of said side posts of said back member respectively for rearwardly supporting said seat member about said back member and positioning said seat member about said first and second arm members, said side rails of said seat member additionally being secured to said first and second arm members, respectively.

11. An upholstered article of furniture capable of being readily assembled and disassembled including a frame structure with upholstery thereon comprising:

a back member including opposite side posts connected to intermediate rails;

first and second arm members each including opposite front and back posts connected by first and second intermediate rails, said first and second arm members being secured to said side posts of said back member respectively during assembly;

a seat member including front and back rails and opposed side rails positioned transversely to and connecting said front and back rails, said side rails of said seat member being securable to said second intermediate rail of said first and second arm members respectively during assembly;

compression means extending between and through each of said side posts of said back member and said first intermediate rail of said first and second arm members respectively for compressing said upholstery on said article of furniture during assembly of said first and second arm members to said side posts of said back member;

first fastening means extending between and through said side posts of said back member and said first and second intermediate rails of said first and second arm members respectively for securing said first and second arm members to said back member after said upholstery on said furniture has been compressed during assembly; and second fastening means extending between and through said side rails of said seat member and said second intermediate rail of said first and second arm members respectively for securing said seat member to said first and second arm members.

12. The article of furniture of claim 11 wherein said means for compressing said upholstery comprises a wing-nut and bolt assembly, said bolt being secured in said first intermediate rail of each of said first and second arm members respectively and extending through an aligned opening respectively in each of said side posts of said back member.

13. The article of furniture of claim 12 wherein each of said side posts of said back member includes an upper triangularly shaped side face portion, said opening in each of said side posts being located in said triangularly shaped side face portion of each of said side posts.

14. The article of furniture of claim 11 wherein each of said first and second intermediate rails of said first and second arm members includes an opening in alignment with an opening in each of said side posts of said back member, said first fastening means comprising the combination of a fastening insert secured in said opening in each of said first and second intermediate rails and a fastening screw extending through each of said aligned openings in said side posts and said intermediate rails into threading engagement with said fastening insert in said openings in each of said first and second intermediate rails of said arm members respectively.

15. The article of manufacture of claim 14 wherein each of said side posts of said back member includes a upper triangularly shaped side face portion and a lower leg unitary therewith, each of said side posts including first and second of said openings for receiving first and second of said fastening screws, said first and second openings being located in said triangularly shaped portion and said leg portion respectively.

16. The article of furniture of claim 11 wherein said second intermediate rail of each of said first and second arm members includes first and second openings in alignment with first and second openings in each of said side rails of said seat member respectively, said second fastening means comprising the combination of a fastening insert secured in each of said first and second openings in each of said second intermediate rails and a fastening screw extending through said aligned openings in each of said side rails and each of said second intermediate rails into threading engagement with said fastening insert in said first and second openings in each of said second intermediate rails of said arm members respectively.

17. The article of furniture of claim 11 wherein each of said side rails of said seat member includes a free rear end and each of said side posts of said back member includes a front face with a notch therein, said free rear end of each of said side rails being seatable in said notch in each of said side posts of said back member respectively for positioning and securing said seat member about said back member and said first and second arm members.

18. The article of furniture claim 11 wherein said second intermediate rail of each of said first and second arm members includes first and second openings therein, each of said side rails of said seat member including a free rear end and first and second openings, each of said side posts of said back member including a front face with a notch therein, said free rear end of each of said side rails being seatable in said notch in each of said side posts respectively for securing said seat member about said back member and aligning said first and second openings in said side rails with said first and second openings in said second intermediate rail of each of said first and second arm members, said second fastening means extending through said aligned openings to secure said seat member to said first and second arm members.

* * * * *

UNITED STATES PATENT AND TRADEMARK OFFICE

CERTIFICATE OF CORRECTION

PATENT NO. : 5,678,897

DATED : October 21, 1997

INVENTOR(S) : Joseph C. Prestia

It is certified that error appears in the above-indentified patent and that said Letters Patent is hereby corrected as shown below:

Column 2, line 49, "BRIEF DESCRIPTION OF THE DRAWIN" should read --BRIEF DESCRIPTION OF THE DRAWINGS--.

Column 7, line 43 "10 assembly" should be deleted and --and easily-- should be inserted.

Signed and Sealed this

Sixth Day of January, 1998

*Attest:*

*Attesting Officer*

BRUCE LEHMAN

*Commissioner of Patents and Trademarks*